US010515732B2

(12) United States Patent
Clough et al.

(10) Patent No.: US 10,515,732 B2
(45) Date of Patent: Dec. 24, 2019

(54) SEALING APPARATUS FOR MITIGATING EMISSIONS OF HAZARDOUS GASES

(71) Applicant: ATOMIC ENERGY OF CANADA LIMITED, Chalk River (CA)

(72) Inventors: Malcolm James Clough, Pembroke (CA); Jintong Li, Deep River (CA); Harry Adams, Deep River (CA); Randy Hampel, Petawawa (CA); Neil Briden, Deep River (CA); Naweed Munir, Deep River (CA)

(73) Assignee: ATOMIC ENERGY OF CANADA LIMITED, Chalk River (CA)

( * ) Notice: Subject to any disclaimer, the term of this patent is extended or adjusted under 35 U.S.C. 154(b) by 1024 days.

(21) Appl. No.: 14/776,166

(22) PCT Filed: Mar. 14, 2014

(86) PCT No.: PCT/CA2014/050242

§ 371 (c)(1),
(2) Date: Sep. 14, 2015

(87) PCT Pub. No.: WO2014/138996

PCT Pub. Date: Sep. 18, 2014

(65) Prior Publication Data

US 2016/0042824 A1 Feb. 11, 2016

Related U.S. Application Data

(60) Provisional application No. 61/784,875, filed on Mar. 14, 2013.

(51) Int. Cl.
*G21F 5/12* (2006.01)
*G21F 9/02* (2006.01)

(52) U.S. Cl.
CPC . *G21F 5/12* (2013.01); *G21F 9/02* (2013.01)

(58) Field of Classification Search
CPC .... G21F 5/12; G21F 9/02; G21F 5/02; G21K 5/02; B01J 20/20; B01D 47/021; A62D 3/30; F16L 55/07; F17C 13/00
See application file for complete search history.

(56) References Cited

U.S. PATENT DOCUMENTS 5,102,615 A 4/1992 Grande et al.
5,145,820 A * 9/1992 Liang ..... B01J 20/20 423/236

(Continued)

FOREIGN PATENT DOCUMENTS

EP 1335387 A2 8/2003

OTHER PUBLICATIONS

International Search Report dated May 30, 2014 in respect of International Application No. PCT/CA2014/050242.

(Continued)

*Primary Examiner* — Lily C Garner
(74) *Attorney, Agent, or Firm* — Bereskin & Parr LLP

(57) ABSTRACT

A sealing apparatus for mitigating emissions of a hazardous gas flowing between first and second regions. A body of the apparatus includes at least one inlet, at least one outlet spaced apart from the at least one inlet, and a channel connecting the at least one inlet and the at least one outlet in fluid communication. Treatment material housed in at least a portion of the channel is adapted to treat the hazardous gas to form a conditioned gas. In use, the hazardous gas being emitted from the first region is received at the at least one inlet, and the conditioned gas is discharged to the second region at the at least one outlet. The apparatus may be used in combination with a storage container housing radioactive or other toxic waste.

19 Claims, 5 Drawing Sheets

(56) References Cited

U.S. PATENT DOCUMENTS

| | | | | |
|---|---|---|---|---|
| 6,186,128 | B1 * | 2/2001 | Diotte | F01M 13/022 123/572 |
| 6,519,307 | B1 | 2/2003 | Singh et al. | |
| 10,049,777 | B2 * | 8/2018 | Singh | G21F 5/005 |
| 2006/0270961 | A1 | 11/2006 | Costa et al. | |
| 2011/0172484 | A1 | 7/2011 | Singh et al. | |
| 2012/0037632 | A1 | 2/2012 | Singh et al. | |
| 2012/0083644 | A1 | 4/2012 | Singh et al. | |

OTHER PUBLICATIONS

International Preliminary Report on Patentability dated Sep. 15, 2014 in respect of International Application No. PCT/CA2014/050242.

Extended European Search Report dated Nov. 21, 2016 in respect of European Application No. 14765073.3.

* cited by examiner

SEALING APPARATUS FOR MITIGATING EMISSIONS OF HAZARDOUS GASES

CROSS-REFERENCE TO RELATED APPLICATIONS

This is a national stage application of International Application No. PCT/CA2014/050242 filed on Mar. 14, 2014, which claims priority to U.S. Provisional Application No. 61/784,875 filed on Mar. 14, 2013, and the entire contents of each are hereby incorporated herein by reference.

FIELD

The present disclosure relates to apparatuses for providing a gas seal between two regions. The present disclosure also relates to nuclear technology.

BACKGROUND

The following is not an admission that anything discussed therein is prior art or part of the knowledge of persons skilled in the art.

In some nuclear waste storage, fuel processing or reprocessing, nuclear decontamination and/or decommissioning activities, it is desirable to avoid or at least reduce release of radioactive gases and other hazardous gases, for example, mercury, to the environment. Radioactive gases, for example, iodine and xenon, may leak out from between a storage container and its lid, and be released to the environment. Furthermore, it is desirable to avoid or at least reduce gas emissions without having to substantially change existing storage facilities.

INTRODUCTION

The following is intended to introduce the reader to the detailed description that follows and not to define or limit the claimed subject matter.

An aspect of the present disclosure relates to a sealing apparatus for mitigating emissions of a hazardous gas flowing between first and second regions. The apparatus may include: a body including at least one inlet, at least one outlet spaced apart from the at least one inlet, and a channel connecting the at least one inlet and the at least one outlet in fluid communication; and treatment material housed in at least a portion of the channel, the treatment material adapted to treat the hazardous gas to form a conditioned gas, wherein, in use, the hazardous gas being emitted from the first region is received at the at least one inlet, and the conditioned gas is discharged to the second region at the at least one outlet.

The at least one inlet may be formed along an inner surface of the body and extends outwardly therefrom, and the at least one outlet may be formed along an outer surface of the body and extends inwardly therefrom. The at least one outlet may be offset laterally from the at least one inlet so that the treatment material defines an elongate flow path through the channel between the at least one inlet and the at least one outlet. The apparatus may include a plurality of the inlets and a plurality of the outlets, wherein each of the outlets may be offset laterally from a respective adjacent one of the inlets so that the treatment material defines an elongate flow path through the channel between the inlets and the outlets.

The body may be generally ring-shaped, and the channel may be generally annular. The apparatus may include a plurality of the inlets and a plurality of the outlets, wherein the inlets are spaced apart circumferentially along an inner surface of the body and extend outwardly therefrom, and the outlets are spaced apart circumferentially along an outer surface of the body and extend inwardly therefrom. Each of the outlets may be offset circumferentially from a respective adjacent one of the inlets so that the treatment material defines an elongate flow path through the channel between the inlets and the outlets.

The channel may be formed along an upper surface of the body. The apparatus may include a top plate coupled to the upper surface of the body for enclosing the channel. The apparatus may include an internal gasket arranged between the body and the top plate for bearing against the treatment material. The top plate may include a recess in general alignment with the channel, and the internal gasket may be housed in the recess. The recess may be wider than the channel and may overlie the channel. The internal gasket may include inward and outward edges that extend beyond inward and outward sides of the channel, respectively. The upper surface of the body may include inward and outward grooves adjacent to the channel on opposing sides thereof for locating the inward and outward edges of the internal gasket, respectively.

The apparatus may include a filter screen arranged between the at least one outlet and the channel, for preventing ingress of foreign material into the treatment material, and for preventing the treatment material from being discharged from the at least one outlet. The apparatus may include a top gasket coupled to an upper surface of the body, and/or a bottom gasket coupled to a lower surface of the body. The apparatus may include at least one clip coupled to the body for releasably positioning the apparatus, and/or at least one magnet coupled to the body for releasably positioning the apparatus.

The treatment material may consist of an adsorbent material. The treatment material may include charcoal impregnated with triethylenediamine.

An aspect of the present disclosure relates to, in combination: a storage container including at least one side wall; a lid for substantially enclosing an interior of the storage container; and the sealing apparatus as disclosed herein arranged generally between the at least one side wall and the lid, wherein the first region is the interior of the storage container, and the second region is an environment surrounding the storage container. The storage container may house radioactive waste generated from Mo-99 isotope production.

An aspect of the present disclosure relates to a method of mitigating emissions of a hazardous gas flowing between a storage container and an environment surrounding the storage container. The method may include: arranging a sealing apparatus generally between the storage container and the environment; receiving the hazardous gas at at least one inlet of the sealing apparatus; flowing the hazardous gas through a treatment material of the sealing apparatus, to form a conditioned gas; and discharging the conditioned gas at at least one outlet of the sealing apparatus to the environment.

The step of flowing may include flowing the hazardous gas along a channel connecting the at least one inlet and the at least one outlet in fluid communication, the treatment material being housed in at least a portion of the channel.

The hazardous gas may include at least one of a radioactive gas and a toxic gas. The treatment material may consist of an adsorbent material. The treatment material may include charcoal impregnated with triethylenediamine.

The method may include housing radioactive waste generated from Mo-99 isotope production in the storage container.

Other aspects and features of the teachings disclosed herein will become apparent, to those ordinarily skilled in the art, upon review of the following description of the specific examples of the present disclosure.

BRIEF DESCRIPTION OF THE DRAWINGS

The drawings included herewith are for illustrating various examples of apparatuses and methods of the present disclosure and are not intended to limit the scope of what is taught in any way. In the drawings.

DETAILED DESCRIPTION

Various apparatuses or methods will be described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below, or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, for example, a continuing patent application, and the applicant(s), inventor(s) and/or owner(s) do not intend to abandon, disclaim or dedicate to the public any such invention by its disclosure in this document.

Figure 1:
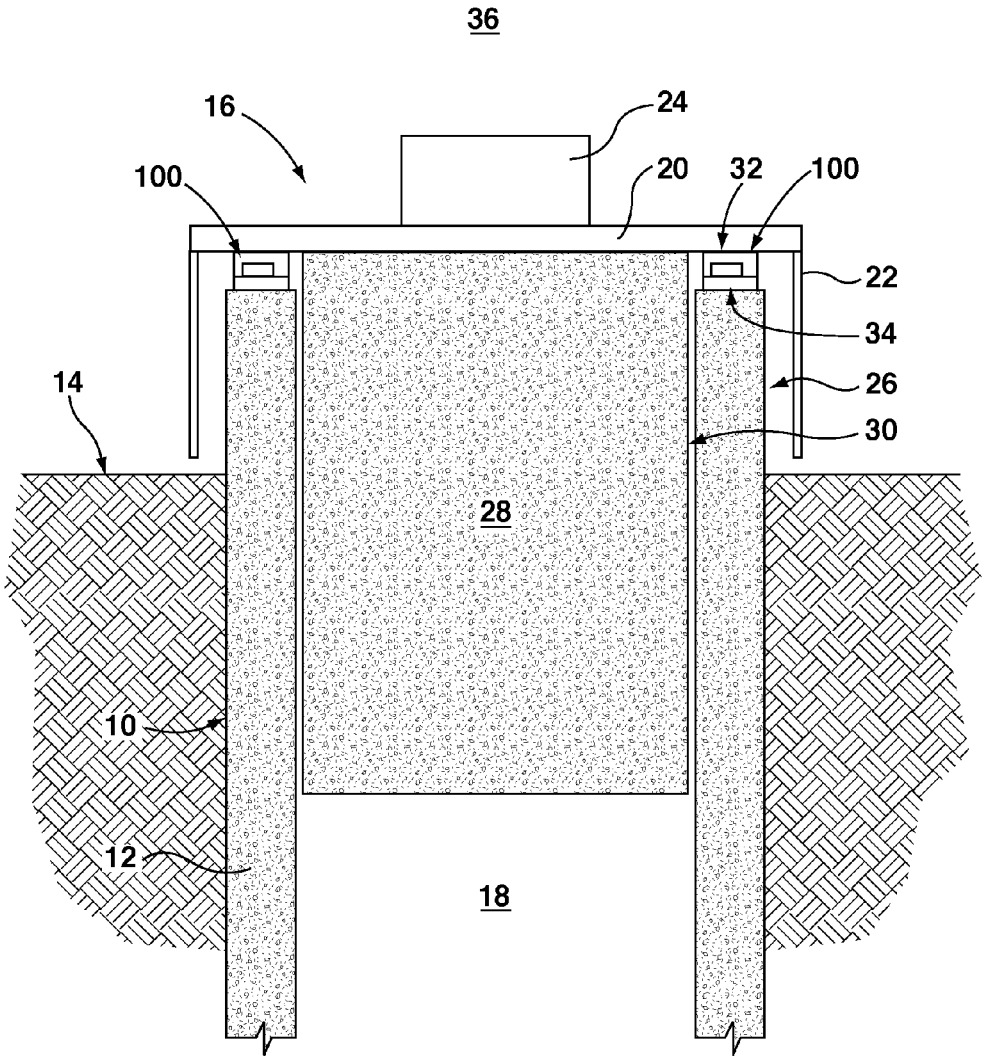
FIG. 1 is a schematic sectional view of a storage container, a lid of the storage container, and a sealing apparatus.

Referring to FIG. 1, a storage facility is shown to include a storage container 10. The storage container 10 includes at least one side wall 12, which may be generally cylindrical and may be formed of concrete. The side wall 12 is shown extending below a ground surface 14, so that at least a portion of an interior 18 of the storage container 10 lies below the ground surface 14. In some examples, the storage container 10 may extend up to 18' under the ground surface 14, or more.

A lid 16 is arranged to substantially enclose the interior 18 of the storage container 10. In the example illustrated, the lid 16 includes a top plate 20, which may be formed of steel. A side wall 22 is mounted along an outer edge of the top plate 20 and extends downwardly therefrom. A top cap 24 is mounted to a top surface of the top plate 20. The side wall 22 may be generally cylindrical, and extends around a periphery of the side wall 12, defining a gap 26.

The lid 16 is shown to further include a shield plug 28 mounted to a bottom surface 32 of the top plate 20. The shield plug 28 may be formed of concrete. The shield plug 28 is arranged generally within the interior 18 of the storage container 10 with clearance therebetween, defining a gap 30. The gaps 26, 30 permit fluid flow between the interior 18 of the storage container 10 and an environment 36 surrounding the storage container 10.

A sealing apparatus 100 is shown arranged between a top surface 34 of the side wall 12 of the storage container 10 and the bottom surface 32 of the top plate 20 of the lid 16. The sealing apparatus 100 may be used to mitigate emissions of a hazardous gas flowing between the interior 18 of the storage container 10 and the environment 36.

The arrangement of FIG. 1 may be used for nuclear waste storage. For example, Mo-99 isotope production may generate radioactive waste. This waste may undergo a cementation and packaging process, resulting in cans of cemented Mo-99 waste. Each waste can may be transported from a production facility to a storage facility, and the storage container 10, which may be referred to as a "tile hole", may be filled with the waste cans are placed therein. The lid 16 and the shield plug 28 may then be inserted into the storage container 10, to enclose the interior 18.

Once placed in the storage container 10, the contents of the waste cans may continue to release radioactive gas emissions of I-131 and Xe-133, for example. Without the sealing apparatus 100, the storage container 10 and the lid 16 does not provide for mitigating release of emissions during storage. Furthermore, due to gaps that may be present between the steel surface 32 and the uneven concrete surface 34, the joint between the surfaces 32, 34 may not be effective in preventing gas leakage, and this leak path may allow radioactive gases to escape to the environment 36.

Figure 2:
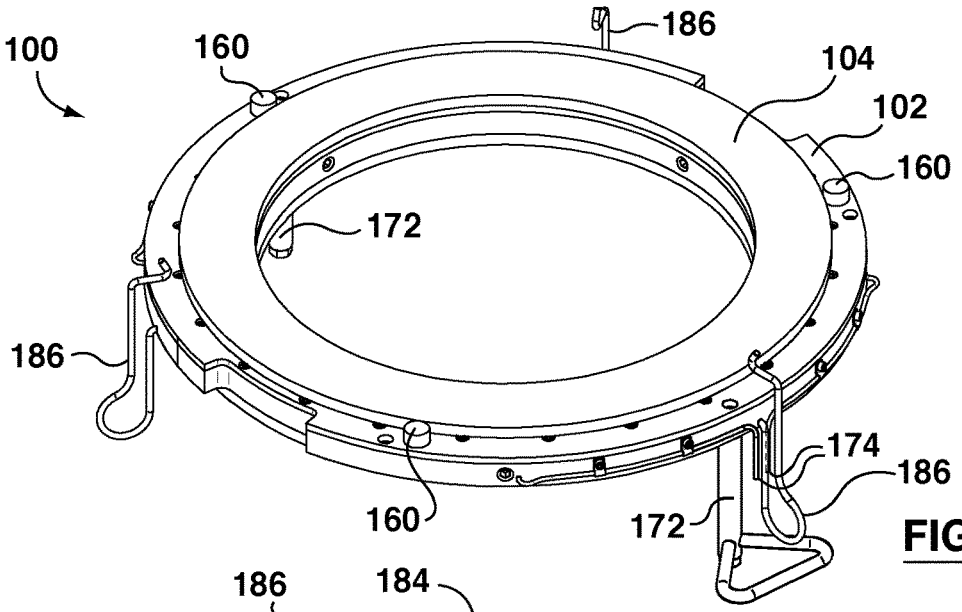
FIG. 2 is a perspective view of a sealing apparatus according to an example.
Figure 3:
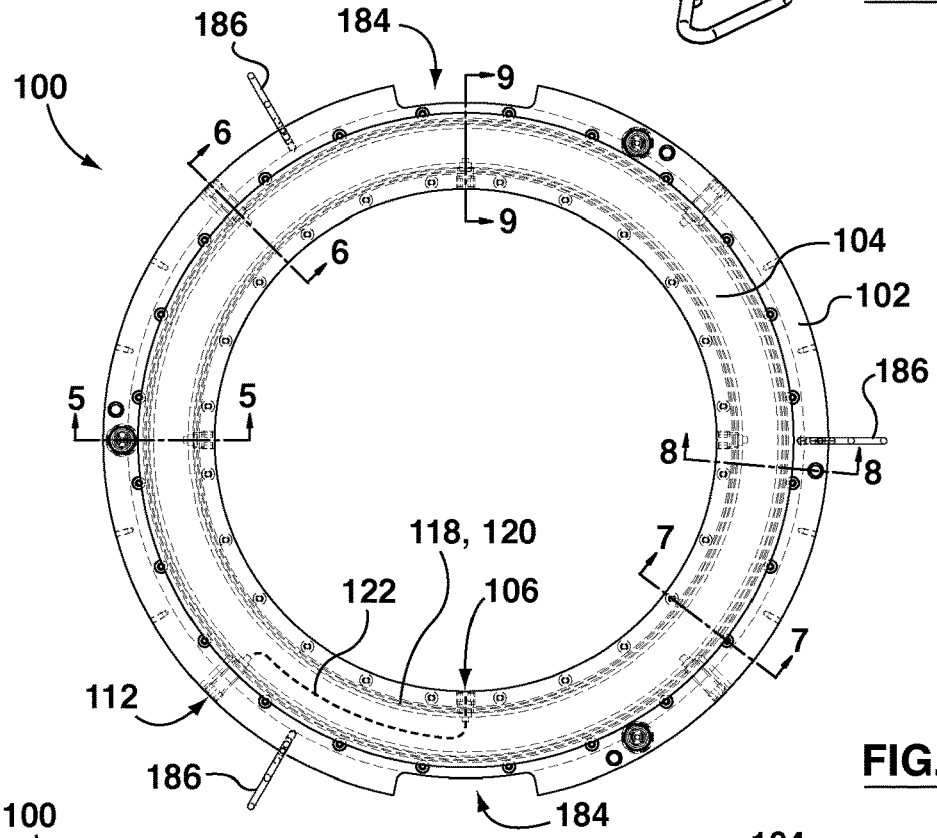
FIG. 3 is a top view of the apparatus of FIG. 2.
Figure 4:
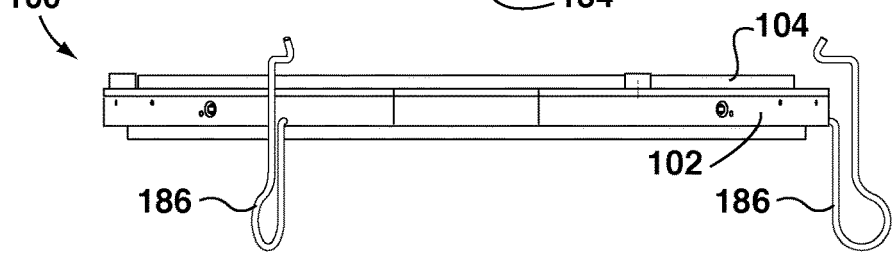
FIG. 4 is a side view of the apparatus of FIG. 2.

Referring now to FIGS. 2, 3 and 4, the sealing apparatus 100 according to an example includes a body or bottom plate 102, and a top plate 104 coupled to an upper surface of the body 102. In the example illustrated, each of the body 102 and the top plate 104 are generally ring-shaped; other shapes are possible. Each of the body 102 and the top plate 104 may be machined from aluminum.

Figure 5:
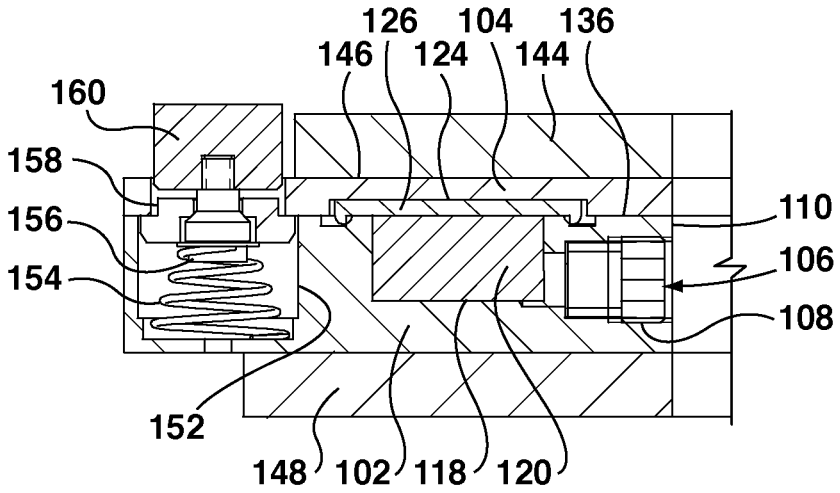
FIG. 5 is a sectional view of the apparatus of FIG. 3 along line 5-5.

Referring to FIG. 5, the body 102 includes at least one inlet 106 that is formed by an inlet bore 108 arranged along an inner surface 110 of the body 102. The inlet 106 extends outwardly relative to the inner surface 110. In the example illustrated, four of the inlets 106 are spaced apart circumferentially along the inner surface 110 of the body 102 (FIG. 3).

Figure 6:
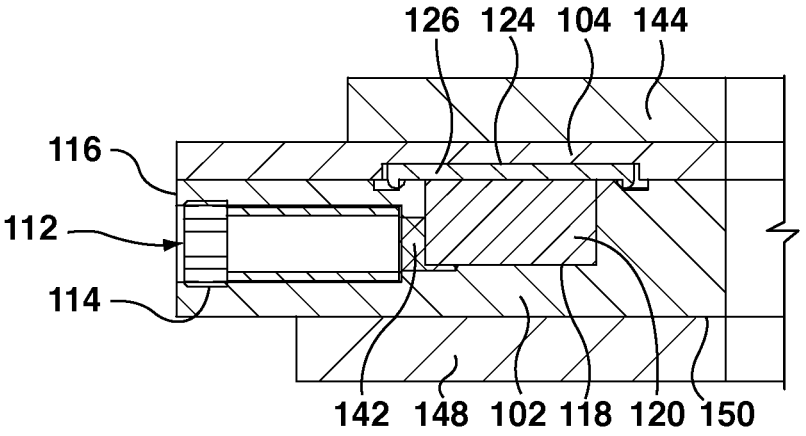
FIG. 6 is a sectional view of the apparatus of FIG. 3 along line 6-6.

Referring to FIG. 6, the body 102 includes at least one outlet 112 that is formed by an outlet bore 114 arranged along an outer surface 116 of the body 102. The outlet 112 extends inwardly relative to the outer surface 116. In the example illustrated, four of the outlets 112 are spaced apart circumferentially along the outer surface 116 of the body 102 (FIG. 3).

In the example illustrated, each of the inlets 106 and the outlets 112 include a hollow fastener that is affixed to the body 102, to provide a relatively rigid structure at the inlets 106 and the outlets 112.

The body 102 further includes a channel 118 connecting the inlets 106 and the outlets 112 in fluid communication. In the example illustrated, the channel 118 is generally annular. Treatment material 120 is housed in the channel 118. The treatment material 120 may be selected for treatment of a hazardous gas to form a conditioned gas. In some examples, the treatment material may trap or adsorb the hazardous gas, thereby forming the conditioned gas having less hazardous content. The hazardous gas is received at the inlets 106, and flows passively through the treatment material 120. The conditioned gas is discharged at the outlets 112. Thus, in use, the sealing apparatus 100 may mitigate emissions of the hazardous gas flowing between the storage container 10 and the environment 36 surrounding the storage container 10 (FIG. 1).

In some examples, the hazardous gas may be a radioactive gas such as I-131 and Xe-133 emissions, or may be a toxic gas such as mercury vapor. In some examples, the treatment material 120 may consist of an adsorbent material. In some examples, the treatment material 120 may consist of charcoal impregnated with triethylenediamine. In the case of iodine, the iodine becomes chemically attached to the active sites within the charcoal impregnated with triethylenediamine (chemisorption). This may prevent or at least reduce the release of iodine and other gases to the environment.

In the case of Mo-99 waste, measurements of iodine emissions from existing storage containers have indicated that iodine will decay over about a three month period (i.e. 8.5 day half-life). Hence, the design of the sealing apparatus 100 may only require functionality over a three month period, and may be removed at a 5 year inspection of the storage container 10, if needed.

Flow in both directions, into and out of the storage container 10, via the sealing apparatus 100 may occur, for example, due to continuing exothermic reactions within the open vented containers that house radioactive waste. Initially it is expected that gases will flow, via natural convection, from the storage container 10 to the environment 36 when the pressure differential favors that flow direction. It is also possible the direction of flow could reverse when the ambient pressure becomes greater than that within the storage container 10. Because of the ability of the storage container 10 to breathe relative to the ambient atmosphere, a buildup of pressure inside the storage container 10 may be prevented. Thus, the design of the sealing apparatus is such that hazardous gases may be treated and vented simultaneously, preventing the storage container 10 from becoming a pressure vessel, which may be undesirable.

As shown in FIG. 3, each of the outlets 112 may be offset circumferentially (e.g., 45 degrees) from a respective adjacent one of the inlets 106 so that the treatment material 120 defines an elongate flow path 122 through the channel 118 between the inlets 106 and the outlets 112.

Referring again to FIG. 5, the channel 118 is formed along an upper surface 136 of the body 102, and the top plate 104 encloses the channel 118. In the example illustrated, the top plate 104 includes a recess 124 that is in general alignment with the channel 118. An internal gasket 126 is arranged within the recess 124 for bearing against the treatment material 120.

Without the internal gasket 126, there may be a void or gap between a top surface of the treatment material 120 and a bottom surface of the top plate 104. Such a void or gap may form and may increase in size due to settling of the treatment material 120 over time, after assembly of the sealing apparatus 100. Such a void or gap may provide a bypass for gases around the treatment material 120, which would prevent these gases from flowing through the treatment material 120. The internal gasket 126 may be compressible and may take up volume within the channel 118, to reduce voids or gaps when settling of the treatment material 120 occurs over time, and thereby prevent or at least reduce bypass of gases around the treatment material 120. Also, during manufacture, tapping the treatment material 120 (e.g., with a soft mallet) while filling the channel 118 may encourage settling.

Figure 7:
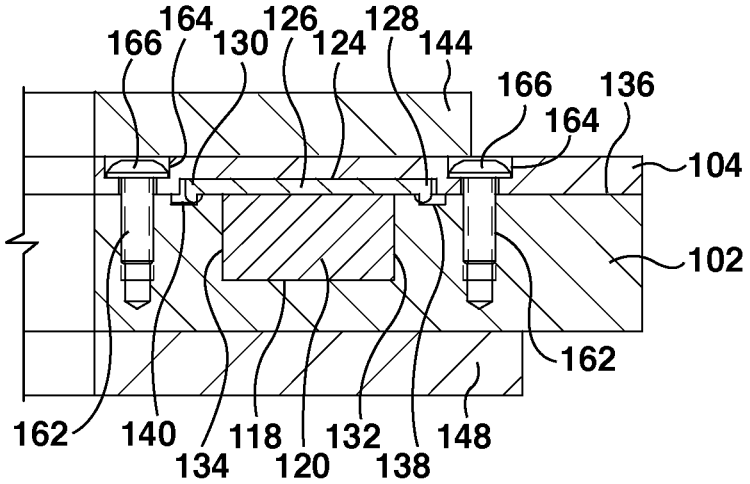
FIG. 7 is a sectional view of the apparatus of FIG. 3 along line 7-7.

Referring now to FIG. 7, the recess 124 may be wider than the channel 118 and overlie the channel 118. In the example illustrated, the internal gasket 126 includes inward and outward edges 128, 130 that extend beyond inward and outward sides 132, 134 of the channel 118, respectively. Furthermore, the upper surface 136 of the body includes inward and outward grooves 138, 140 adjacent to the channel 118 on opposing sides thereof. The grooves 138, 140 may allow the compressed volume of the internal gasket 126 to be taken up, and may also help locate the inward and outward edges 128, 130 of the internal gasket 126, respectively.

In some examples, the recess 124 in the top plate 104 may be omitted. Instead, the height of the upper surface 136 of the body 102 between the grooves 138, 140 on either side of the channel 118 may be reduced to accommodate the thickness of the internal gasket 126 when arranged between the body 102 and the top plate 104. In such examples, the top plate 104 may be made from a standard stock width material, and the internal gasket 126 is housed within the body 102. In other examples, the internal gasket 126 may be housed in partial recesses (not shown) in both the top plate 104 and the body 102.

Referring again to FIG. 6, a filter screen 142 may be arranged between the outlet 112 and the channel 118, for preventing ingress of foreign material into the treatment material 120, and for preventing the treatment material 120 from being discharged from the outlets 112.

FIG. 5 shows a top gasket 144 coupled to an upper surface 146 of the top plate 104. FIG. 6 shows a bottom gasket 148 coupled to a lower surface 150 of the body. The gaskets 144, 148 are formed of a compressible material, and designed to have sufficient compression to prevent bypass of gases around the treatment material 120, as described above.

Referring to FIG. 5, the body 102 may include a cavity 152 that houses a spring 154. A spring cap 156 couples the spring 154 to a shoulder 158, which is movable vertically within the cavity 152.

As illustrated in FIGS. 2, 3 and 4, the sealing apparatus 100 may include spring clips 186 for facilitating releasable attachment and positioning of the sealing apparatus 100 to the lid 16 (FIG. 1). Three of the clips 186 are shown positioned about the body 102.

In the example illustrated, the clips 186 are each formed from a single wire connected to the outer side surface of the body 102. The clips 186 are shaped to retain the side wall 22 of the lid 16 (FIG. 1), with a top horizontal portion of the clip 186 engaging a top surface of the top plate 20 of the lid 16 (FIG. 1). In other examples, the clip may be formed of a loop of single wire that is connected in two places spaced apart along the outer side surface of the body 102, which may prevent rotation of the clip relative to the body 102.

Referring again to FIG. 5, a magnet 160 is shown connected to the shoulder 158. In some examples, the magnet 160 may facilitate releasable attachment and positioning of the sealing apparatus 100 to the bottom surface 32 of the top plate 20 of the lid 16, which may be formed of steel. The magnets 160 may be implemented as an alternative to the clips 186, or may be used in combination with the clips 186. In the example illustrated, three of the magnets 160 are shown positioned about the body 102 (FIG. 2). The magnets 160 may be neodymium magnets. Sufficient clearance between the cavity 152 and the shoulder 158 allows the magnet 160 to accommodate angular difference between top surfaces of the three magnets 160 and the bottom surface 32 of the top plate 20 at the three locations of engagement.

As illustrated in FIG. 5, each of the magnets 160 may be positioned so that its upper surface stands proud of the top gasket 144, in order to prevent compression of the top gasket 144 until the lid 16 and the sealing apparatus 100 are installed onto the storage container 10. Once installed onto the storage container 10, mass of the lid 16 and the sealing apparatus 100 causes the spring 154 and the top gasket 144 to compress. In other examples, spring clips (not shown) may be used in place of the magnets 160 for positioning the sealing apparatus onto the lid 16.

Referring now to FIG. 7, the body 102 may include mounting holes 162 and the top plate 104 may include corresponding apertures 164 for receiving fasteners 166. The fasteners 166 may provide a solid connection between the body 102 and the top plate 104. However, in other examples, other means of bonding the body 102 and the top plate 104 together are possible, including adhesive, brazing or welding, for example.

Figure 8:
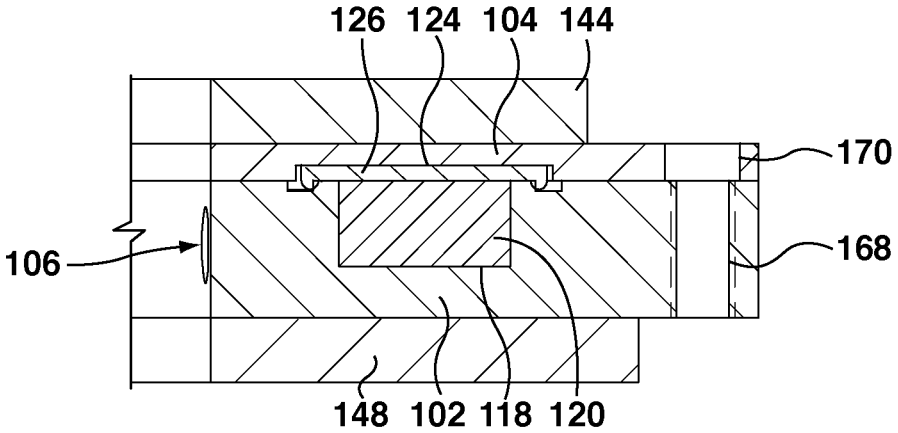
FIG. 8 is a sectional view of the apparatus of FIG. 3 along line 8-8.

Referring to FIG. 8, the body 102 may include a further hole 168 and the top plate 104 may include a corresponding aperture 170 for attachment of two installation handles 172, shown in FIG. 2. The installation handles 172 may be used for positioning the sealing apparatus onto the lid 16, before installation on the storage container 10 (FIG. 1). Once the sealing apparatus 100 is attached to the lid 16, the installation handles 172 may be removed, for example, by unscrewing them from the hole 168. The installation handles 172 may also be used as legs to avoid compression of the bottom gasket 148 during storage before installation.

FIG. 2 also shows thermocouple ends 174. A thermocouple (not shown) may fit inside a blind hole (not shown) that is machined close to one of the outlets 112. The thermocouple may provide a means of measuring the temperature at the outlet 112 to determine if there is a potential for freezing and blockage.

Figure 9:
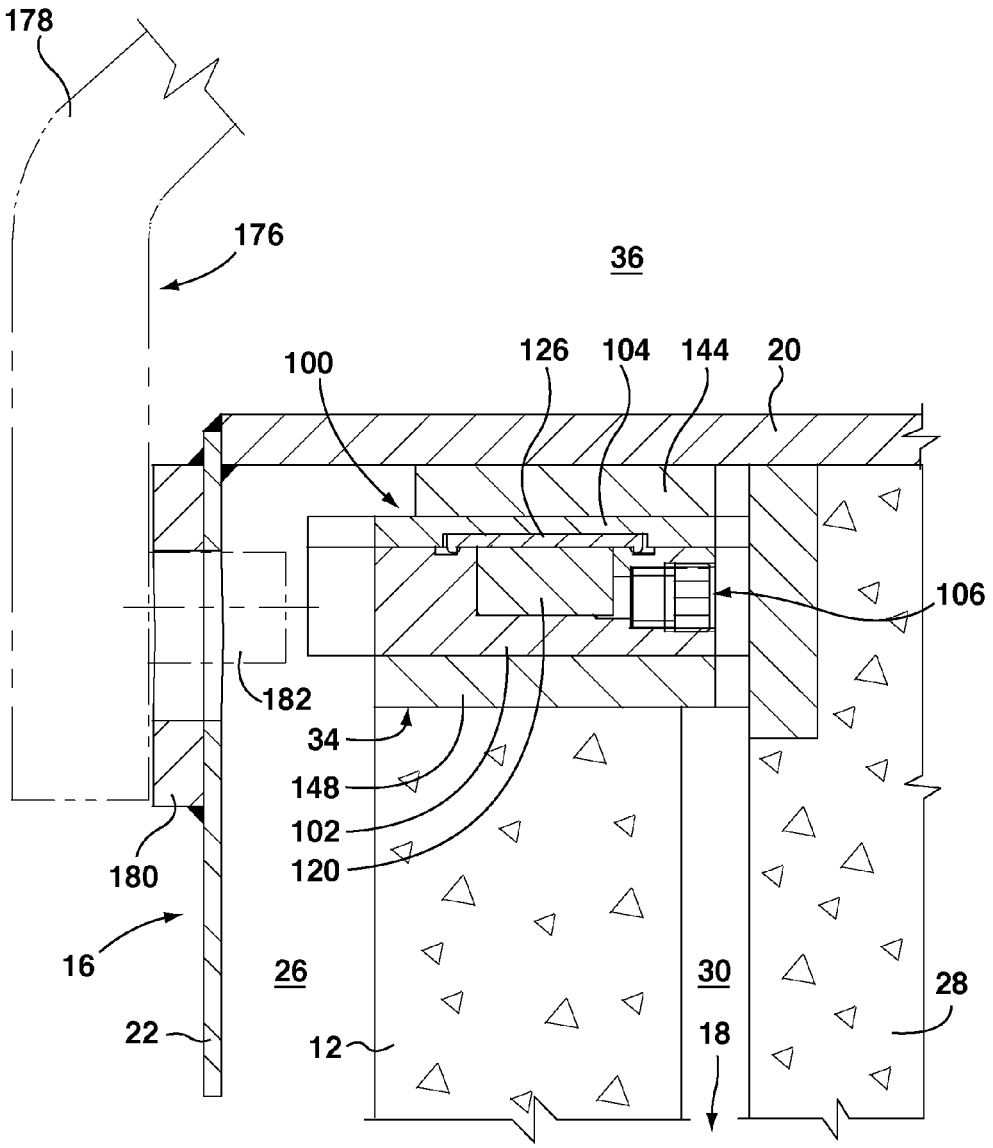
FIG. 9 is a sectional view of the apparatus of FIG. 3 along line 9-9, and showing portions of the storage container, the lid of the storage container, and a lifting apparatus for the lid.

Referring now to FIG. 9, a lifting device 176 for lifting the lid 16 and the sealing apparatus 100 up and away from the side wall 12 may include an arm 178 that is coupled to a pivot mount 180 by a connector 182. To accommodate the lifting device 176, the body 102 may include corresponding cutouts 184 (FIG. 3).

Laboratory tests carried out by the inventors demonstrated that the sealing apparatus may direct 99.99% of a hazardous gas through the treatment material, and further that blocking of the outlets caused by freezing under conditions of high humidity and cold temperatures is unlikely.

The inventors conducted field tests using prototypes of the sealing apparatus described herein, installed at an existing "tile hole" storage site for radioactive waste from Mo-99 isotope production. NUSORB® TEG™ material was implemented as the treatment material. There were two sets of gas emission measurements taken from tile holes without the sealing apparatus. There were four sets of gas emission measurements taken from tile holes with the sealing apparatus. For one of the tile holes, there were two sets of measurements taken to monitor emissions over a four day period. In each case, I-131 and Xe-133 emissions were measured after the lid was positioned to enclose the tile hole.

The field test results are summarized in Tables 1 and 2.

TABLE 1

Emissions measurements without sealing apparatus.

| | Bq/week | |
|---|---|---|
| Storage container | I-131 | Xe-133 |
| 1 | 7.02E+07 | 1.19E+12 |
| 2 | 2.11E+07 | 1.94E+12 |

TABLE 2

Emissions measurements with sealing apparatus.

| | Bq/week | |
|---|---|---|
| Storage container | I-131 | Xe-133 |
| 3 | 2.78E+05 | 7.57E+10 |
| 3 (four days later) | 7.75E+05 | 2.02E+12 |
| 4 | 1.70E+06 | 7.53E+10 |
| 5 | 4.69E+05 | 1.78E+11 |

The I-131 emissions were lower by approximately two orders of magnitude when the sealing apparatus was fitted compared to the measurements without the sealing apparatus. There was a drop in Xe-133 emissions by approximately one order of magnitude. For storage container 3, the observed increase in apparent emissions over the four day period was consistent with the understood post irradiation behavior of isotopes, and the measurements were still relatively low.

While the above description provides examples of one or more processes or apparatuses, it will be appreciated that other processes or apparatuses may be within the scope of the accompanying claims.

We claim:

1. A sealing apparatus configured for use with a storage container housing radioactive waste for mitigating emissions of a hazardous gas flowing between an interior of the storage container and an environment surrounding the storage container, the apparatus comprising:

a body comprising at least one inlet, at least one outlet spaced apart from the at least one inlet, and a channel connecting the at least one inlet and the at least one outlet in fluid communication; and treatment material housed in at least a portion of the channel, the treatment material adapted to treat the hazardous gas to form a conditioned gas, wherein the at least one inlet is formed along an inner surface of the body and extends outwardly therefrom, and the at least one outlet is formed along an outer surface of the body and extends inwardly therefrom, wherein the at least one outlet is offset laterally from the at least one inlet so that the treatment material defines an elongate flow path through the channel between the at least one inlet and the at least one outlet, and wherein, in use, the hazardous gas being emitted from the interior of the storage container is received at the at least one inlet, and the conditioned gas is discharged to the environment at the at least one outlet.

2. The apparatus of claim 1, comprising a plurality of the inlets and a plurality of the outlets, wherein each of the outlets is offset laterally from a respective adjacent one of the inlets so that the treatment material defines the elongate flow path through the channel between the inlets and the outlets.

3. The apparatus of claim 1, wherein the body is generally ring-shaped, and the channel is generally annular.

4. The apparatus of claim 3, comprising a plurality of the inlets and a plurality of the outlets, wherein the inlets are spaced apart circumferentially along the inner surface of the body and extend outwardly therefrom, and the outlets are spaced apart circumferentially along the outer surface of the body and extend inwardly therefrom.

5. The apparatus of claim 4, wherein each of the outlets is offset circumferentially from a respective adjacent one of the inlets so that the treatment material defines the elongate flow path through the channel between the inlets and the outlets.

6. The apparatus of claim 1, wherein the channel is formed along an upper surface of the body, and comprising a top plate coupled to the upper surface of the body for enclosing the channel.

7. The apparatus of claim 6, comprising an internal gasket arranged between the body and the top plate for bearing against the treatment material.

8. The apparatus of claim 7, wherein the top plate comprises a recess in general alignment with the channel, and the internal gasket is housed in the recess.

9. The apparatus of claim 1, comprising a filter screen arranged between the at least one outlet and the channel, for preventing ingress of foreign material into the treatment material, and for preventing the treatment material from being discharged from the at least one outlet.

10. The apparatus of claim 1, comprising a top gasket coupled to an upper surface of the body, and a bottom gasket coupled to a lower surface of the body.

11. The apparatus of claim 1, comprising at least one of a clip and a magnet coupled to the body for releasably positioning the apparatus.

12. The apparatus of claim 1, wherein the treatment material consists of an adsorbent material.

13. The apparatus of claim 12, wherein the treatment material comprises charcoal impregnated with triethylenediamine.

14. The apparatus of claim 8, wherein the recess is wider than the channel and overlies the channel.

15. The apparatus of claim 7, wherein the internal gasket comprises inward and outward edges that extend beyond inward and outward sides of the channel, respectively.

16. The apparatus of claim 15, wherein the upper surface of the body comprises inward and outward grooves adjacent to the channel on opposing sides thereof for locating the inward and outward edges of the internal gasket, respectively.

17. A sealing apparatus configured for use with a storage container housing radioactive waste for mitigating emissions of a hazardous gas flowing between an interior of the storage container and an environment surrounding the storage container, the apparatus comprising:

a body comprising at least one inlet, at least one outlet spaced apart from the at least one inlet, and a channel connecting the at least one inlet and the at least one outlet in fluid communication; and treatment material housed in at least a portion of the channel, the treatment material adapted to treat the hazardous gas to form a conditioned gas, wherein the channel is formed along an upper surface of the body, and comprising a top plate coupled to the upper surface of the body for enclosing the channel, comprising an internal gasket arranged between the body and the top plate for bearing against the treatment material, wherein the top plate comprises a recess in general alignment with the channel, and the internal gasket is housed in the recess, wherein the recess is wider than the channel and overlies the channel, and wherein, in use, the hazardous gas being emitted from the interior of the storage container is received at the at least one inlet, and the conditioned gas is discharged to the environment at the at least one outlet.

18. A sealing apparatus configured for use with a storage container housing radioactive waste for mitigating emissions of a hazardous gas flowing between an interior of the storage container and an environment surrounding the storage container, the apparatus comprising:

a body comprising at least one inlet, at least one outlet spaced apart from the at least one inlet, and a channel connecting the at least one inlet and the at least one outlet in fluid communication; and treatment material housed in at least a portion of the channel, the treatment material adapted to treat the hazardous gas to form a conditioned gas, wherein the channel is formed along an upper surface of the body, and comprising a top plate coupled to the upper surface of the body for enclosing the channel, comprising an internal gasket arranged between the body and the top plate for bearing against the treatment material, wherein the internal gasket comprises inward and outward edges that extend beyond inward and outward sides of the channel, respectively, and wherein, in use, the hazardous gas being emitted from the interior of the storage container is received at the at least one inlet, and the conditioned gas is discharged to the environment at the at least one outlet.

19. The apparatus of claim 18, wherein the upper surface of the body comprises inward and outward grooves adjacent to the channel on opposing sides thereof for locating the inward and outward edges of the internal gasket, respectively.

* * * * *